United States Patent [19]

Kenney et al.

[11] 4,006,110

[45] * Feb. 1, 1977

[54] MANUFACTURE OF FREE-FLOWING PARTICULATE HEAVY DUTY SYNTHETIC DETERGENT COMPOSITION

[75] Inventors: Edward J. Kenney, Bernardsville; Frank R. Smith, Jr., North Plainfield; Walter A. DiSalvo, North Arlington, all of N.J.

[73] Assignee: Colgate-Palmolive Company, New York, N.Y.

[ * ] Notice: The portion of the term of this patent subsequent to Sept. 24, 1991, has been disclaimed.

[22] Filed: May 13, 1974

[21] Appl. No.: 469,502

Related U.S. Application Data

[63] Continuation of Ser. No. 203,365, Nov. 30, 1971, abandoned, which is a continuation-in-part of Ser. No. 124,111, March 15, 1971, Pat. No. 3,838,072, and a continuation-in-part of Ser. No. 134,324, April 15, 1971, Pat. No. 3,886,098.

[52] U.S. Cl. ..... 252/540; 252/531; 252/532; 252/535; 252/536; 252/539

[51] Int. Cl.[2] ..... C11D 1/22; C11D 1/83

[58] Field of Search ..... 252/99, 135, 539, 540, 252/531, 532, 535, 536, 559; 117/100

[56] References Cited

UNITED STATES PATENTS

| | | | |
|---|---|---|---|
| 3,461,074 | 8/1969 | Schwalley | 252/109 |
| 3,519,570 | 7/1970 | McCarty | 252/135 |
| 3,538,004 | 11/1970 | Gabler et al. | 252/99 |
| 3,558,498 | 1/1971 | Eymery et al. | 252/135 |
| 3,562,171 | 2/1971 | Guida | 252/186 |
| 3,700,600 | 10/1972 | Nagel et al. | 252/99 |
| 3,838,072 | 9/1974 | Smith, Jr. et al. | 252/540 |

FOREIGN PATENTS OR APPLICATIONS

| | | |
|---|---|---|
| 808,945 | 2/1969 | United Kingdom |
| 918,499 | 2/1963 | United Kingdom |
| 939,878 | 10/1963 | United Kingdom |

*Primary Examiner*—Leland A. Sebastian
*Attorney, Agent, or Firm*—Herbert S. Sylvester; Murray M. Grill; Norman Blumenkopf

[57] ABSTRACT

A heavy duty built synthetic organic detergent powder is made without the need for phosphates or carbonates in the formulation thereof by preparing a base product, such as by spray drying an aqueous mix of an anionic synthetic organic detergent and alkali metal silicate, for example, a crutcher mix of higher linear alkyl benzene sulfonate, sodium silicate, sodium sulfate and water, in certain proportions, spraying a nonionic detergent onto the dry base and blending with it a powdered anti-redeposition agent. The product made is a free-flowing detergent of desired density and particle size and the process is readily effected in a tumbling drum or twin shell blender without producing excessive lumping or tackiness.

10 Claims, 3 Drawing Figures

MANUFACTURE OF FREE-FLOWING PARTICULATE HEAVY DUTY SYNTHETIC DETERGENT COMPOSITION

This application is a continuation of application Ser. No. 203,365 filed Nov. 30, 1971 and now abandoned which was in turn a continuation-in-part of applications Ser. No. 124,111 filed Mar. 15, 1971 and now U.S. Pat. No. 3,838,072, and Ser. No. 134,324 filed Apr. 15, 1971 and now U.S. Pat. No. 3,886,098.

A wide variety of synthetic organic detergent compositions has been made in the past, based on anionic, nonionic, cationic, amphoteric or other synthetic organic detergents and inorganic and organic builders. Normally, the most preferred particulate detergents have been those based on synthetic anionic detergents, with sodium tripolyphosphate as the builder. In recent years, nonionic detergents have been included in such formulas for their specially desirable properties. As a rule they are biodegradable and resistant to hard water conditions. However, recent moves directed to the diminution of contents of phosphates and carbonates in detergents or their complete removals, together with withdrawals of governmental approvals of phosphates, carbonates and nitrilotriacetates have caused searching reviews of detergent formulations in efforts to determine whether satisfactory cleaning agents can be made without such builder salts.

As a result of such research, the present applicants, in the above-mentioned patent applications, have described methods they discovered for producing detergent compositions which could have low contents of phosphates and/or carbonates, with the building properties of the omitted inorganic builder salts(s) being made up by other such builders, including, primarily sodium silicates. Although the preparations of detergent formulations by the mere mixing of ingredients is readily possible for such built but phosphate- and carbonate-free products, usually it is very difficult to produce them in a satisfactory manner. This is so because the phosphates, especially pentasodium tripolyphosphate and tetrasodium pyrophosphate, have long been employed as builders and as excellent sorbents for liquids in detergent components and tended to make free-flowing those compositions containing normally tacky materials. Accordingly, by the methods described in the patent applications referred to above, it was important to add nonionic detergent, normally liquid or semi-solid (semi-solids are classified as solids herein), as a spray or coating onto particles of the detergent composition. By such additions, with the formulas described in the applications, nonionic detergents were satisfactorily sorbed and the products were free-flowing. Of course, if too much of a liquid or near-liquid nonionic detergent was post-added onto the base particles, the product could become tacky or sticky and would not be free-flowing. Also, if the nonionic detergent was added in the crutcher before spray drying, much of it would be lost up the stack and out the exhaust of the spray tower, causing objectionable pluming, which is environmentally highly undesirable. It is thought that with respect to the poly-lower alkoxylated synthetic organic nonionic detergents, the surfactants having shorter polyethoxyethanol chains, e.g., of 1 to 4 ethoxies, are more susceptible to pluming and since most of such detergent products contain mixed chain lengths, only limited quantities of the nonionics (up to about 3%) can be tolerated in the crutcher without pluming resulting.

The techniques described in the patent applications, wherein a small portion of the nonionic detergent might be spray dried with the crutcher mix and another portion could be postsprayed onto the beads, worked well so long as the content of the detergent composition was regulated so as to provide satisfactory sorbents for tacky materials or to diminish the contents of such materials in the product. Thus, in Ser. No. 124,111, it was desirable to limit the content of anionic detergent, since such material is normally tacky, limit the content of sodium silicate, since it has been found that this material in the crutcher prevented sorption of the nonionic sprayed onto the base particles, thereby making them lump, and include in the formulation phosphates and carbonates, because of their sorptive powers. Also, to aid in penetration of the overspray material, a thinner nonionic, of lower ethoxy content was often desirably employed. In Ser. No. 134,324, at least 5% of sodium carbonate was used for its sorptive and building effects and the amount of nonionic detergent was limited.

Altough the presences of phosphates and carbonates and limiting of the content of anionic sythetic organic detergent allowed the production of satisfactorily free-flowing product, it has now been found that by omitting carbonate and phosphate contents entirely, or except for small or negligible amounts thereof (e.g., up to 2%) which might be present, and utilizing even more anionic detergent, products are obtainable which flow freely and contain enough detergent to be effective washing agents. These are producible by techniques similar to those described in the previously mentioned applications. Although it would appear that utilizing more silicate and more synthetic anionic organic detergent would lead to a tacky product, it has been found that the product made is sufficiently free flowing to be useful or can have flow properties further improved by treatment with flow-inducing clays or powders, such as Satintone, Cab-O-Sil, clays, etc. Also, the sorptive actions of the carbonates and phosphates are apparently compensated for by the silicates and fillers, such as sodium sulfate, which may be present in the formulation. Although applicants do not wish to be bound by the theory, it appears that at the high concentrations of anionic detergents, these affect the silicates in such a way that they no longer present impermeable and non-sorptive barriers to the nonionic being sprayed onto the particles. Such a change in properties of the silicate is strange because when anti-redeposition gums are included in the crutcher mix, they still make the product tacky, as die the silicates in former formulations, despite the presence of the higher proportions of synthetic anionic detergents. Other reasons for the improved flowability of the high anionic - high silicate formulas of the present invention, when "coated" with nonionic overspray, relate to the larger particle sizes obtainable by spray drying such formulations and the improved uniformity of the detergent beads to be coated with the nonionic. It appears that the high anionic detergent content of the crutcher mix also helps to prevent the high silicate content from separating out in the crutcher or in the lines to the spray nozzles and thereby allows the production of a better spray pattern and more uniform particle sizes. Because of the higher anionic detergent content the moisture analysis of the product may be higher and the presence of a greater proportion of moisture in the beads being dried helps to diminish the danger of pluming of the nonionic or of heat sensitive anionic synthetic organic detergent being dried. Another advantage of the present formulations is that the flowability of the product after leaving the tumbling drum is essentially the same as that of the packed product after lengthy storage periods. Thus, uniformity of flowability can be achieved and a comparatively constant flow condition for the stored products is obtainable.

In accordance with the present invention a method of manufacturing a free-flowing particulate heavy duty synthetic organic detergent composition comprises preparing a particulate detergent composition comprising a water soluble anionic sulf(on)ate synthetic organic detergent having a higher linear alkyl chain therein, and sodium silicate, the particles being substantially all within the 6 to 140 mesh U.S. Standard Sieve Series range and containing less than 5% of particles passing through a 200 mesh sieve, with the ratio of sulf(on)ate detergent to sodium silicate being from 3:1 to 1:3, and spraying onto the surfaces of the particles, while maintaining them in motion, from 1 to 6% of a normally solid nonionic detergent in liquid state at an elevated temperature, with the amount of nonionic detergent in the product being from 1/15 to ¼ that of the anionic detergent. In preferred embodiments of the invention the an:on:c detergent is sodium higher linear alkyl benzene sulfonate, especially of the dodecyl or tridecyl types, the silicate is of a $Na_2O:SiO_2$ ratio of 1:1.6 to 1:3, the nonionic detergent is a higher alkoxy polyethoxyethanol wherein the alkoxy is of 12 to 18 carbon atoms and in which the ethoxy content is from 7 to 15 moles per mole of detergent, the base beads are spray dried from a crutcher mix containing a substantial proportion of sodium sulfate, and the spraying of the nonionic onto the base beads is at a temperature in the 40° to 70° C. range, with spray droplets in the 5 microns to 2 millimeters range and with an anti-redeposition agent mixed with the detergent base beads during the tumbling and spraying operations. Preferred proportions of constituents are from 15 to 35% of the anionic suf(on)ate detergent, 15 to 35% of sodium silicate, 1 to 8% of nonionic detergent (including that crutched and dried and that oversprayed), 10 to 65% of sodium sulfate, 3 to 15% of moisture and 0.5 to 5% of anti-redeposition agent.

The various compositions, methods, operations, constructions, conditions, detailes, uses and advantages of the invention will be apparent from the following description, taken in conjunction with the illustrative drawing of a preferred embodiment of the apparatus used to practice the method of the invention, in which drawing.

Figure 1:
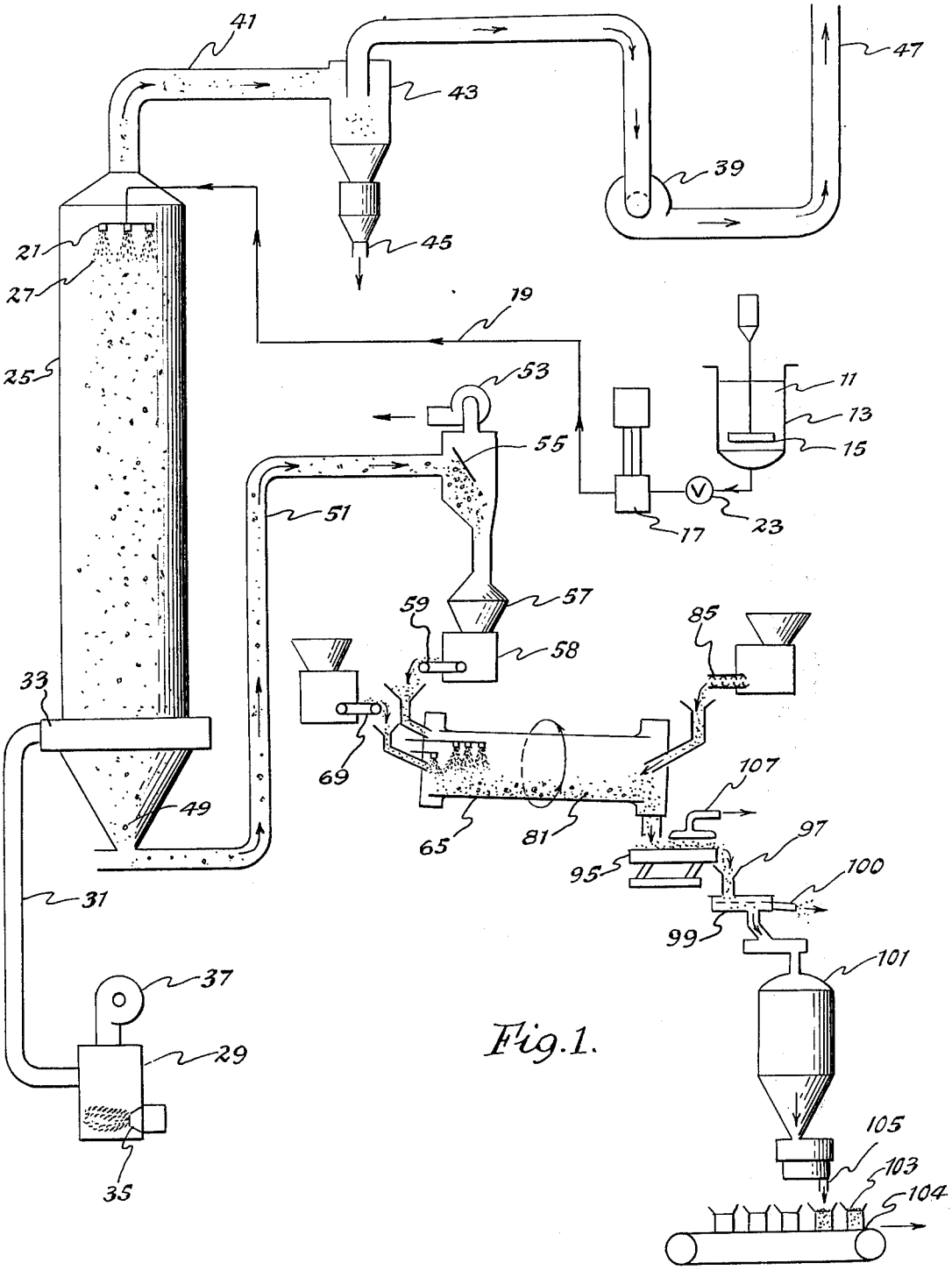
FIG. 1 is a schematic flow diagram showing the manufacture of an oversprayed spray dried detergent.
Figure 2:
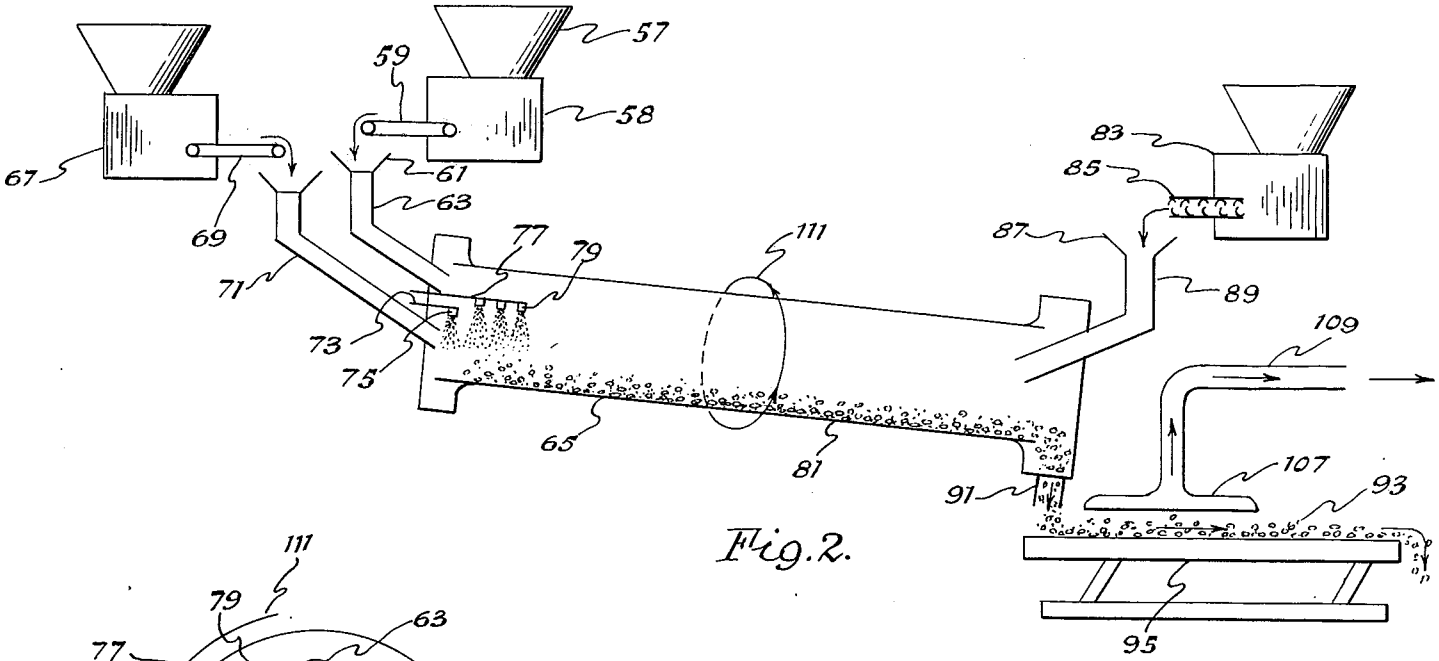
FIG. 2 is an enlarged partially sectional side elevation of tumbling apparatus employed in the practice of the invention.

In FIG. 1, aqueous detergent base or builder crutcher mix 11 is agitated in crutcher 13 by stirring means 15 which maintains it in substantially homogeneous condition. Heating means, not shown, are usually employed to raise and regulate the crutcher mix temperature so as to increase the solubilities or dispersibilities of the detergent components and to diminish the mix viscosity, so as to facilitate spraying. A high pressure pump 17, capable of producing pressures of 200 to 2,000 lbs./sq. in., pumps the crutcher mix through line 19 and spray nozzles 21 when valve 23 is opened. In spray tower 25 the sprayed droplets 27 of crutcher mix pass downwardly through an upwardly moving stream of heated air generated by burner 29, which air passes into the spray tower 25 through duct 31 and inlet ring 33. As illustrated, the heated air or combustion products result from burning gas or oil passed through nozzle 35 with air supplied by blower 37. A vacuum is drawn on the spray tower by blower 39 and the spent drying air is removed from the tower through duct 41 and cyclone separator 43, which removes fine particles from the air at 45, allowing the cleaned air to be vented at outlet 47, after having passed through blower 39. Additional air cleaning means, such as bag-type dust separators, may also be used in conjunction with the cyclone separator but are not illustrated herein. The spray dryer illustrated is of countercurrent design and such is preferred but concurrent dryers are also useful.

The dried builder or detergent composition particles 49, usually in hollow globular or bead form, are removed from the spray drying tower by gravity and air lift 51, which is operated by vacuum generated by blower 53, and the particles travel past baffle 55 to hopper 57 for bin 58, from which they are ready to be fed to a tumbling apparatus for post spraying to make the product of this invention.

The various parts of the overspraying apparatus next described are better illustrated in enlarged FIGS'S. 2 and 3 than in FIG. 1. Belt feeder 59 carries spray dried base beads 49 from bin 58 under hopper 57 through hopper 61 and passage 63 into continuous tumbling drum 65. Instead of utilizing the continuously rotating drum illustrated, other continuously moving tumblers, such as twin shell blenders, may be employed. Such other tumblers or the present drum, if suitably modified, may be used in batch operations. In the preferred continuous operation, other adjuvants which it may be desirable to add before or at the early stages of tumbling may be fed from bin 67 by feed belt 69 through line 71 to drum 65. Materials desirably added at this time include anti-redeposition agents, such as sodium carboxymethyl cellulose and sometimes, extra sodium silicate, often as hydrous sodium silicate. In enzyme-containing detergents, the enzymes may be added at such points of farther down the tumbling drum.

Perfume and/or any other liquid additives which are insufficiently stable to be spray dried or which for any other reasons are desirably added after spray drying, may be forced onto the base beads through line 73 and out spray nozzle 75 or through other similar lines and nozzles. usually, slightly farther down stream than the "perfume addition" nozzle or nozzles there are located the nonionic detergent overspray nozzles 79 and the overspray material, with or without additional additives mixed with it, is passed through line 77 and sprayed onto the tumbling detergent base particles. As illustrated, three such nonionic detergent spray nozzles are shown, each of which is separated from the next adjacent nozzle by from one to two feet. Separations may be varied, depending on the size of the drum, and can be from six inches to three feet. The number of nozzles is usually from one to eight. In some instances, other normally liquid, melted or dissolved components of the final product formulation may be pre-mixed with the nonionic detergent or with a nonionic detergentantifoam mixture and this may be sprayed onto the tumbling particles. After sufficient residence time in the tumbling drum, preferably in continuous operation, the treated detergent particles 81 may have other powdered additives mixed with them, usually to improve flow and reduce tackiness. Thus, a finely divided clay, talc or other suitable "lubricant" or flow-inducing agent, such as calcined aluminum silicate (Satintone), may be added to the tumbling drum near the downstream end thereof by feeding it from bin 83 through screw feeder 85, hopper 87 and line 89. The various screw feeds, belt feeds and pumping rates for the liquids to be mixed and sprayed are regulatable individually or may be controlled by a proportioning mechanism, not shown, which maintains the desired balances of the various materials to be charged. Thus, the entire operation may be automated.

After production of the oversprayed detergent particles 81 and dusting thereonto of flow-inducing powder or other suitable finely divided materials, if utilized, the product is removed through exit 91 and forms a bed 93 on vibratory feeder 95. This bed of material is transported by the feeder to hopper 97 past screen 99 to filling bin 101, from which it is discharged to packages 103 passing along belt 104 under filling head 105. The packages are then automatically closed, sealed, cased and shipped. Any oversize particles failing to pass through screen 99 are discharged at takeoff 100. These and other oversized and undersized particles may be re-worked or otherwise further processed to be made suitable for blending with the rest of the oversprayed detergent particles produced.

Although it is not intended to effect substantial evaporation of moisture or other volatiles in the tumbling drum 65, a slight flow of air through the drum is maintained by applying vacuum to the downstream end thereof, as illustrated by vacuum hood 107. The hood is so formed as to exert a slight effect on bed 93 of oversprayed particles and through the bed to cause an air flow from the upstream to the downstream end of the tumbling drum. Thus, any very finely divided mist-like droplets of liquid to be oversprayed onto the detergent particles will be drawn by the vacuum through the bed 93 and deposited on the particles, if this is not completely effected in the tumbling drum. Colloidal liquid not so deposited and very finely divided solid particles are removed via line 109.

Figure 3:
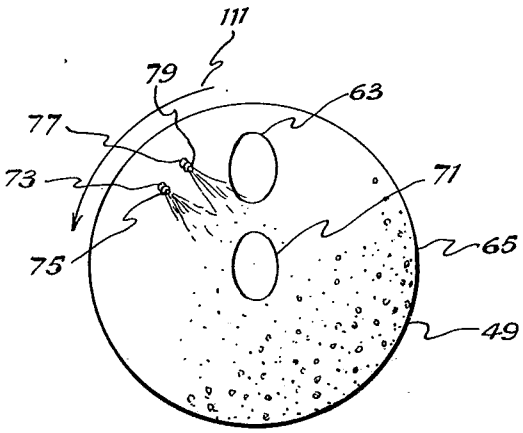
FIG. 3 is a sectional end elevation of the apparatus of FIG. 2.

FIG. 3 shows the relative positioning of the various lines for the addition of the detergent base or builder particles, sodium carboxymethyl cellulose or other resinous or gum antiredeposition agents or other particulate additives, overspraying liquid including a nonionic detergent, and perfume or other liquid additives. It will be noted that nozzles 75 and 79 are so directed as to spray the liquids onto the moving particles 49, which action avoids production of large quantities of tailings due to overconcentrations of the liquids on apparatus walls or on any relatively quiescent materials near the points of spraying. Arrow 111 indicates the direction of rotation of the tumbling drum.

Detergent compositions that may be prepared by the method of this invention are those silicate-built anionic detergents based on sulfated or sulfonated lipophilic groups containing a higher alkyl group, preferably a higher linear alkyl, of 10 to 12 to 18 carbon atoms. In this specification, such sulfated and sulfonated materials will be referred to generically as "sulf(on)ated". They will usually be employed as alkali metal salts, preferably sodium salts, but may also be used as other water soluble salts, such as those of magnesium, calcium and aluminum, in addition to the ammonium, mono-, di-, and tri-lower alkyl amines and mono-, di-, and tri-lower alkanolamines, each of the alkyl and alkanol groups having from 1 to 4 carbon atoms. The sulf(on)ated anionic detergents include the linear alkyl aryl sulfonates, such as the sodium higher alkyl benzene sulfonates and the sodium higher alkyl toluene sulfonates; the higher alkyl sulfates, e.g., sodium lauryl sulfate; the sodium coconut oil fatty alcohols sulfate, sodium oleyl sulfate; the sodium salts of amides of N-methyl taurine, e.g., Igepon T; the water soluble sodium salts of fatty esters of isethionic acid (Igepon A); higher fatty acid monoglyceride sulfates and sulfonates, e.g., coconut oil fatty acids monoglyceride sulfate, sodium salt; higher linear olefin sulfonates e.g., hydroxyalkane sulfonates and alkenyl sulfonates, including mixtures of long chain ($C_{12-18}$) alkenyl sulfonates (sodium salts) and long chain hydroxyalkane sulfonates (sodium salts); higher alkyl ethoxamer sulfates and methoxy-higher alkyl sulfates, such as those of the formulas $RO(C_2H_4O)_nSO_3M$, wherein R is a fatty alkyl of 10 or 12 to 18 carbon atoms, n is 2 to 6 and M is a solubilizing, salt-forming cation, such as alkali metals, ammonium, amines and alkanolamines previously mentioned, and

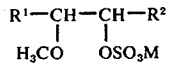

wherein $R^1$ and $R^2$ are selected from the group consisting of hydrogen and alkyls, with the total number of carbon atoms in $R^1$ and $R^2$ being in the range of 10 to 18. For both types of the alkoxamer sulfate detergents mentioned the preferred compounds are those in which R is about 14 to 15 and the sum of $R^1$ and $R^2$ is about the same.

Lengthier descriptions of the anionic synthetic organic detergents may be found in three patent applications of Paul S. Grand, mailed to the U.S. Patent Office about Nov. 10, 1971, and entitled Detergent Compositions, Sulfonate Detergent Compositions and Sulfate Detergent Compositions, respectively. These applications also describe various other components of the present formulations, including silicates, nonionic detergent components, anti-redeposition agents and adjuvants and give formulas for suitable detergent including such materials.

With the anionic synthetic organic detergent there is employed an inorganic silicate or a mixture of such silicates as a builder, to improve the detersive effect of the organic compound. Although other builder salts may be employed to produce useful heavy duty detergents, the proportions of phosphates and carbonates will normally be held to minima, rarely being over 2% each in the present compositions. Larger quantities of sodium bicarbonate may be employed instead of carbonate but this material possesses lesser building effect and will also generally be avoided. In some formulations it may be desired to have present borax, borates and perborates, usually as the sodium salts but in several sections of the country boron-containing ions are also objectionable, especially in those areas devoted to the growing of citrus fruits. Accordingly, the most preferred embodiment of the present invention is one in which the only builders are the innocuous silicates. Should clearance ultimately be given to EDTA and NTA as organic builders, such compounds may be included in these compositions to the extent of about 5 to 30% but at present they are omitted entirely.

Of the silicates, the soluble alkali metal salts, such as those of sodium and potassium are preferable and, although wide varieties of ratios of $M_2O:SiO_2$, wherein M is alkali metal, have been employed, the preferred building silicates which are not objectionably alkaline are those wherein $M_2O:SiO_2$ is between about 1:16 to 1:3, preferably from 1:2 to 1:2.7, most preferably about 1:2.35 or 1:2.4. The silicates used may be in granular form or preferably, when compounded with the other ingredients in the crutcher mix, are in aqueous solution, e.g., at 43.5% solids content. In addition to builder salts, filler compounds, preferably inorganic salts such as the water soluble alkali metal sulfates and chlorides, e.g., sodium sulfate, sodium chloride, sodium bisulfate, either as anhydrous salts or an hydrates, may be used. Such materials do not improve detergency but do function as bulking agents and often aid is sorbing liquid, nearliquid and tacky ingredients, so as to promote flow of the product.

In the crutcher mix there may also be incorporated, if desired, a higher fatty acid soap, such as the alkali metal soaps of higher fatty acid or glyceride mixtures obtained from animal fats and vegetable oils of well-known soapmaking types, e.g., coconut oil and tallow mixtures of respective proportions from 10:90 to 50:50. Such soaps, especially those of sodium, aid in producing excellent detergent base beads when employed in correct proportions with the other crutcher mix constituents and yet, do not inhibit the sorption of the nonionic detergent or surface active agent applied to such beads.

In the crutcher mix or in the mixture of materials employed to make the detergent base particles there may be present a small quantity, less than 0.5% of a soil anti-redeposition agent of the synthetic or natural organic gum type, such as polyvinyl alcohol, sodium carboxymethyl cellulose, hydroxypropyl methyl cellulose, methyl cellulose, sodidum alginate, polyvinyl pyrrolidone or locust bean gum. Such materials, of which the sodium carboxymethyl cellulose is preferred, aid in preventing soil from depositing on the laundry through which the wash water is being drained. They maintain the soil in finely divided colloidal form so that it is removed with the waste water. The proportion of such a gum in the detergent base bead is held low, as described, to promote sorption of the nonionic sprayed onto such beads.

Various other well-known adjuvants may be incorporated in the formulas of the present compositions and may be added in the crutcher mix, ribbon mixer, micropulverizer or other suitable blending and/or size-reducing apparatus. Thus, there may be included in the appropriate portion of the formula anti-foaming agents, for those compositions where a minimum of foam is desirable; emollients; humectants, e.g., glycerol; solvents, e.g., ehtanol, propylene glycol; optical brighteners, such as those described in the article by Per S. Stensby entitled Optical Brighteners and Their Evaluation, published in *Soap and Chemical Specialties* in April, May, July, August, and September, 1967; bactericides; fungicides; dyes; water dispersible pigments; chelating agents; antioxidants; stabilizers; and perfumes.

After the preparation of the detergent base, which preferably contains little or no nonionic detergent (because of pluming difficulties), the incorporation of nonionic detergent in the product is preferably effected by spraying finely divided droplets of such material in liquid form, preferably at an elevated temperature, onto the surfaces of the moving base particles. The synthetic nonionic detergent applied to the base particles in a mixing or tumbling apparatus will normally be such a compound known to be especially effective for separating dirt, grease, stains and other soils from fabrics, such as cottons, polyesters, cotton-polyester blends, nylons, acrylics, rayons, woolens and other fibrous materials. Such detergents usually contain lipophilic and hydrophilic moieties, generally sufficiently in balance so that the compounds are water soluble and yet have dissolving, solubilizing and/or emulsifying effects on lipophilic soil. For satisfactory detersive activity, rather than wetting or emulsifying effects alone, the lipophilic portion of the detergent molecule will generally contain at least ten or twelve carbon atoms and will be free or substantially free of solubilizing radicals, such as hydroxyls and -O-M- groups, wherein M stands for metal or salt-forming ion such as alkali metal, ammonium, amine or alkanolamine. In preferred embodiments of the invention the nonionic detergent will contain from 10 to 24 carbon atoms in the lipophilic portion thereof, from 10 to 18 of which will usually be in an alkyl group, preferably a linear alkyl. Such alkyl may be joined to an aryl, such as a phenyl toluyl or xylyl group, but is preferably the sole lipophilic portion of the detergent molecule. In most preferred embodiments, the nonionic detergent will include a linear alkyl lipophilic moiety which is unsubstituted and which contains an average of from 12 to 15 carbon atoms, sometimes preferably averaging 14 to 15 carbon atoms. Generally, preferred alkyl will have their carbon atom contents in the narrow ranges previously mentioned for the average, with some extensions beyond these. Thus, from 10 to 18 carbon atoms may be in the higher alkyl or alkoxy porition of the molecules, preferably from 12 to 16 carbon atoms. In the poly-lower alkoxy moiety, the extent of its hydrophilic nature may be regulated by including some polypropoxy groups but these will generally be limited in number to less than ⅓ the number of ethoxy groups because the propoxies, when formed into a chain, are usually lipophilic. Preferably, the chain will be entirely polyethoxy and from 4 to 40 carbon atoms will be present in such poly-lower alkoxy chain, preferably 6 to 30 carbon atoms and more preferably 14 to 22 carbon atoms. Such compounds are available commercially under the trade names Neodol 45-11, Plurafac B-26, Alfonic 1618–65 and Neodol 25–7.

Although not as preferable as the other nonionics already mentioned for the manufacture of the present detergent products, various other nonionic detergents used are as described in the texts *Surface Active Agents and Detergents*, Vol. II, by Schwartz, Perry and Berch, published in 1958 by Interscience Publishers, Inc., and *Detergents and Emulsifiers*, 1969 *Annual* by John W. McCutcheon. Among such nonionic compounds are the higher alkyl phenoxy poly-lower alkoxy lower alkanols, e.g., nonyl phenoxy polyethoxy ethanol (Igepal Co-880) and balanced hydrophilic-lipophilic compounds made by the condensation, either random or block, of hydrophilic lower polyalkylene oxides or lower alkylene oxides (ethylene oxide) with lipophilic lower polyalkylene oxide or lower alkylene oxides (propylene oxides), e.g., Pluronics F-68 and L-44, and various Ucons. The lower alkylene oxides are of two or three carbon atoms and the nonionic detergents that are useful may contain from 4 to 100 moles of lower alkylene oxide per mole of compound.

After mixing in with the detergent base any powdered anti-redeposition agent which may be desirable in the formula, and after the nonionic detergent constituent has been sprayed onto the tumbling base particles, with or without an accompanying anti-foam, e.g., dicocoyl amine, or other adjuvant, when it is desired to improve the slip of the product further so as to make it better flowing and less liable to bridge or become tacky there may be added to it a flow-inducing agent such as a clay, calcined aluminum or magnesium silicate, silica, calcium carbonate, talc or other suitable material, preferably inorganic and water insoluble. The amounts of such slip-promoting agent are small so that it does not form a gritty deposit on the laundry.

The proportions of the various detergent constituents in the final product may vary over a substantial range, providing that certain relationships are maintained between the proportions of silicate and anionic detergent, on the one hand and anionic and nonionic, on the other, and providing that no more than a small percentage of the nonionic detergent is incorporated in the product in the crutcher. Thus, the ratio of anionic sulf(on)ated detergent, such as the linear higher alkyl benzene sulfonate, to sodium silicate, preferably of a $Na_2O:SiO_2$ ratio of about 1:2.35 should be from 3:1 to 1:3, preferably 2:1 to 1:2 and most preferably about 1:1. Maintenance of such a ratio provides enough anionic detergent to keep the silicate from percipitating out in the crutcher mix and prevent it from acting to block sorption of the nonionic. Also, there is enough silicate present to diminish tackiness of the product and provide a solid base for the composition particles. The final amount of nonionic detergent in the product should be from about 1/15 to about ¼ of the anionic detergent, although under some circumstances, as when the cleaning power of the anionic detergent is not needed and the percentage of silicate in the product is small (the proportion of sodium sulfate being increased accordingly), a higher nonionic:anionic ratio may be tolerated. Generally, it will be preferred to have in the product about 1/12 to 1/5 as much of the nonionic detergent as of the anionic. Normally, from 1 to 6% of the total product will be of the described higher alkoxy polyethoxy ethanol nonionic detergent, with preferably no more than 2% and at the very most, 3% of the nonionic having been incorporated in the crutcher mix, with the rest thereof being sprayed on. At least 1% of the nonionic detergent will be sprayed onto the base particles. In some circumstances, as when a flow-favoring agent, such as Satintone, is employed, it has been found possible to include as much as 8% of nonionic detergent of the semi-solid type (preferably Neodol 45-11 or Alfonic 1618–65) in and/or on the detergent particles, providing that they are of the desired size distribution for best sorption of the nonionic. Normally, about 1 or 2% of the nonionic is included in the crutcher mix and a balance of 1 to 3 or 4% thereof is sprayed onto the base particles. The desired size range for the base particles, whether spray dried or granular, is from 6 to 140 mesh, U.S. Standard Sieve Series, with substantially all of the particles within this range (less than 10% being outside the range), and less than %% being sufficiently fine to pass through a 200 mesh sieve. It has been found that when the amounts of fines are increased, they act to cause aggregation of the various particles during post-spraying with nonionic detergent and accompanying tumbling, and thereby create a tacky, poorly flowing product.

Percentagewise, the preferred ranges for the various constituents of the composition made by this invention are such that they include about 15 to 35 % of water soluble anionic sulf(on)ate synthetic organic detergent, 15 to 35% of sodium silicate, 1 to 8% of nonionic detergent, 10 to 65% of sodium silicate, 0.5 to 5% of anit-redeposition agent, 3 to 15% of moisture and 0 to 3%, preferably 0.5 to 2% of flow-inducing powder. Preferred ranges are from 20 to 30% of sodium linear tridecyl benzene sulfonate, 20 to 30% of sodium silicate, 2 to 5% of monionic detergent, 20 to 50% of sodium sulfate, 1 to 3% of anti-redeposition agent and 5 to 12% of moisture. When soap is present in the formula, it will usually be from 1 to 10% thereof, preferably from 2 to 6% of sodium higher fatty acid soap. The various other adjuvants that are employed will normally amount to less than 20% and preferably less than 10% of the product, with percentages of any adjuvant usually being less than 5% and normally less than 2% thereof.

To make the detergents of this invention there is sprayed onto a base of detergent composition in particulate form, the nonionic detergent of the mentioned type which acts to "glue" the powdered anti-redeposition agent (usually of 100 to 200 mesh particle size but which may be as fine as 325 mesh) to the base particles and contributes curd dispersion, cleaning and solvent properties to the product. Although it is possible to spray the nonionic detergent, including additional materials melted into it or fused with it onto various particulate bases, including granulated materials, best results are obtained when the base is in globular (spray dried) form. The spray dried beads will usually have a hollow section therein and a passageway leading from the exterior surface to an interior portion. The particle sizes of the beads or granules onto which the nonionic is sprayed will be in the range of 6 to 200 mesh, preferably 6 to 140 mesh and most preferably, 8 to 100 mesh. As was mentioned before, the percentages of 200 mesh or finer materials should be severely restricted to avoid production of sticky products. Particle size distribution within the ranges given can be normal, although in some cases it may be desirable to remove the finer particles from a grind, as by screening. Ordinarily, most of the particles are of 20 to 80 mesh, less than 10% pass a 100 mesh and preferably less than 1% passes a 200 mesh sieve. The lesser the proportion fines present the more overspray is feasible and the less overspray to be used the less critical is the fines content.

The detergent bases may be obtained by mixing various solid components thereof and grinding or otherwise size-reducing them and classifying or screening to the desired size ranges. Preferably, however, the detergent base particles will be made by spray drying and aqueous slurry or crutcher mix, usually at an elevated temperature, e.g., 40°or 50°to 90° C., at an elevated pressure, e.g., 200 to 2,000 lbs./sq. in., into a spray dring tower containing moving drying gas at an elevated temperature, e.g., 100° or 150° to 400° C. Sizes of the droplets in the tower are approximately those of the final beads but may be initially about half such diameters, with swellings during drying causing bead enlargement and diminutions of apparent densities. The beads will have a bulk density of from 0.1 to 0.8 g./ml., preferably 0.3 to 0.8 g./ml. and their moisture contents will be from 1 to 15%, preferably from 3 to 15% and more preferably, about 5 to 12%.

The crutcher mix composition will preferably be solely inorganic silicate builder salt and anionic detergent in an aqueous medium, with filler salt, e.g., sodium sulfate and sometimes, minor proportions of antiredeposition agent and nonionic detergent. The crutcher mix may also contain the usual adjuvants employed in detergent products. However, the content of nonionic detergent and any other materials susceptible to pluming will be limited to avoid this polluting effect. Usually the proportion of nonionic detergent of the fatty alcohol poly-lower alkoxy lower alkanol type will be less than 3% in the crutcher mix, preferably less than 2% and in the most preferable cases, will be 1% or less. In the best processes, none of the nonionic will be in the crutcher mix and all of it will be post-sprayed onto the detergent beads.

Substantial proportions of nonionic detergents, antiredeposition agents, additional builders (silicates, hydrous silicates), flow-inducing compounds, e.g., calcined aluminum silicate, perfumes, colored detergent particles, etc., may be added to the base beads in the tumbling drum and in some cases the total amount of additives may be equal to the amount of the base (especially if builder and filler are post-added). However, usually less than half of such amount is employed and preferably, the materials added to base beads in the tumbling drum will be from 3 or 5 to 25% of the final composition.

When a crutcher mix is made and the aqueous dispersion is spray dried, the crutcher mix will usually be of a solids content over 25%, e.g., 30 to 80%, and preferably will be about 60 to 75% solids. Because the final products may be of essentially the same composition as the spray dried beads, with only water removed and a minor proportion of materials added to them, the proportions previously recited for the products may be considered to be those utilized in the crutcher mix. Of course, in those cases wherein more substantial proportions of additives are incorporated in the formula in the tumbling drum, the proportions of base material will be considered as being modified accordingly.

After drying of the detergent base beads to a moisture content in the 1 to 20% range, usually from 2 to 15%, the beads will be mixed in the inclined tumbling drum, which may be at an angle of from about 3° to 7° from the horizontal, higher at the inlet end, and the spray of nonionic detergent will be applied to the moving bed of beads, using the apparatus illustrated in FIG'S. 1–3. The spray droplets will preferably be small in size, normally less than 2 mm. and frequently from 5 to 1,000 microns, preferably from 100 to 1,000 microns in diameters. The temperature of the spray will depend to some extent on the melting points of the nonionic compound and any diluent but will usually be in the 40° to 90° C. range, preferably 50° to 70° C. At such temperatures, the sprays are liquid and remain liquid during the period in which they are approaching the detergent beads; yet, they solidify shortly thereafter and do not form a sticky film on the beads. The surfaces of the tumbling beads will be kept in continuous motion, as by rotating in the tube at from 3 to 50 r.p.m., so that new surfaces are continually presented to the liquid being sprayed onto them.

The detergent products made are free-flowing and are not tacky and they contain the nonionic detergent at the surface of the beads, where it can act immediately to solubilize the balance of the detergent composition and to contribute its cleaning power to the wash water and the laundry contacted. In some cases dyes or pigments, e.g., the fluorescent dyes, usually from 0.1 to 2% of the product, can be incorporated in the nonionic detergent spray and the surfaces of the products can be brightened or otherwise colored most effectively. In other applications of the invention compounds having physical properties like waxes or other higher melting materials can be formulated with the nonionic detergents to harden them so as to facilitate solidification thereof when they are sprayed onto the detergent surfaces. For example, there may be used higher melting solids for such purposes, such as those which are waxy or like hard tallow in appearance and physical properties.

In preferred embodiments of the invention, the combinations of desired free-flowing, non-tacky, non-dusting, effectively detergent, non-polluting and ease-of-manufacture properties will be balanced so that a most improved product can be obtained by commercially feasible manufacturing methods. It has been found that the free-flowing characteristics of the product and its ease of manufacture can be greatly improved by utilizing detergent beads or globules of about 6 to 140 mesh, whereas both these properties suffer losses when increased amounts of fines are present.

The following examples illustrate the invention but should not be considered as limiting. Unless otherwise mentioned all temperatures are in ° C. and all parts are by weight.

EXAMPLE 1

| | Pounds |
|---|---|
| Linear dodecyl benzene sulfonate, sodium salt | 1,915 |
| Aqueous sodium silicate solution, 43.5% solids ($Na_2O:SiO_2$ = 1:2.35) | 3,067 |
| Sodium sulfate, anhydrous | 1,896 |
| $RO(CH_2CH_2O)_nCH_2CH_2OH$* | 107 |
| Sodium coco-tallow kettle soap, 70% solids (coco:tallow = 20:80) | 469 |
| Water | 491 |

R equals primary alkyl of 14 to 15 carbon atoms and n equals 10.

The above crutcher mix is prepared in a commercial heated detergent crutcher and is maintained at a temperature of about 80° C. After sufficient mixing, about 5 to 15 minutes, the fluid crutcher mix has air injected into it just before spraying, at the rate of 15 to 20 cubic feet per minute, to regulate spraying properties. The crutcher mix is pumped by a Triplex high pressure pump at a pressure of 700 to 1,200 lbs./sq. in. through six 10-10 detergent spray nozzles at the top of a commercial countercurrent spray drying tower at the rate of 20,000 to 25,000 lbs./hr. The drying air in the tower is at a inlet temperature of about 350° C. and an outlet temperature of 90° to 105° C.

The spray dried detergent beads produced are of a density of about 0.3 g./ml., a moisture content of about 9% and of particle sizes substantially all within the 8 to 100 mesh, U.S. Standard Sieve Series range. Less than 5% of the product passes through a 100 mesh sieve. The product flows very well and is not tacky.

To 94.85 parts of the spray dried detergent powder being tumbled in a plant tumbling drum at the speed of about 15 r.p.m., with the drum being inclined at about 8° from the horizontal, there is added, as illustrated in the drawing, three parts of sodium carboxymethyl cellulose (65% active) in finely powdered form, with particles in the 100 to 200 mesh range, after which there are sprayed onto the surfaces of the tumbling particles two parts of the same semi-solids polyoxyethylated higher alkanol of the formula, in liquid state at a temperture of 50° C. The spray of the nonionic detergent is in atomized form, with the particles thereof in the 5 microns to 2 millimeters diameters range, substantially all of them being in the 10 microns to one millimeter diameter range. Perfume, to the extent of 0.15 part, is sprayed onto the product, using the apparatus shown in the drawing.

Tumbling is continued and charges of detergent beads, nonionic detergent, perfume and anti-redeposition agent are continuously added, with product being taken off at the same rate, maintaining the drum about 1/10th full of tumbling particles. All operations are those described in the specification and all apparatuses employed are those of the drawing, although other tumbling devices may also be utilized and the sprays may be relocated.

The finished product has a bulk density of about 0.3 g./ml., flows almost as well as the uncoated beads and is as non-tacky. The screen analysis is about the same as that of the base bead, with slightly more of the larger particles and less of fines, despite the addition of the finely divided CMC. It analyzes 18% of the mentioned anionic synthetic organic detergent, 37% of sodium sulfate, anhydrous, 25% sodium silicate, 4% of the ethoxylated higher alkanol, 6% of soap, 2% of sodium carboxymethyl cellulose, active ingredient, and 8% of moisture.

When tested for detergency, the product is found to be an excellent detergent and the comparatively low pH, about 9.5, makes it mild enough to be employed without fear of caustic effects sometimes obtained with non-phosphate detergents utilizing sodium carbonate as a builder salt instead of the phosphate. At the mentioned pH and in the presence of the nonionic and anionic detergents, the silicate, as reported in the P.S. Grand applications previously mentioned, does not form scum in the wash water.

In a variation of the above experiment, instead of overspraying with 2% of the nonionic detergent (Neodol 45-11), a 6% overspray of such product is employed, on both a bead having 2% of the nonionic detergent in it and one having none of the nonionic detergent. As might be expected, the higher the percentage of Neodol in the overspray and the higher total percentage in the product the poorer the flow but all such products are of acceptable flow rates. That having a 6% Neodol overspray onto a 2% Neodol bead has a flow rate better than half that of the product of this example described above. Furthermore, tackiness was not unduly objectionable. When 1% of calcined aluminum silicate is added to the tumbling drum in the manner illustrated in the drawing, the flow rate of this 8% Neodol product is improved to be approximately that of the product of the main example and the tackiness is diminished.

In the examples described the detergent beads charged to the tumbling drum or an equivalent twin shell or zig-zag blender are at room temperature, about 25° C., but in variations of the experiments, the beads are taken from the spray dryer within 5 minutes after drying and, at a temperature of about 35° to 40° C., are processed in the drum. In both cases, a free-flowing, non-tacky product results and this is a further advantage of the present method in that it is not necessary to cool and age spray dried detergent beads to be post-coated with the nonionic detergent When, instead of Neodol 45-11, other such nonionic detergents, including Plurafac B-26, Alfonic 1618–65 or 1618–60 and Neodol 25–7 are utilized, some of which are liquids and some of which are semi-solids, similar good coating effects are produced, the products resulting are excellent heavy duty built synthetic organic detergents and they are free-flowing and non-tacky. This is also the case when, instead of the sodium dodecyl benzene sulfate, sodium higher alkyl ($C_{14}$) polyethoxy sulfate of six ethoxy groups, $C_{14}$ olefin sulfonate, or other suitable sulf(on)ated and anionic detergent of the type described in the preceding specification is used. Good products also result when the proportions of after-added anti-redeposition compound are varied over the 0.5 to 5% range, when the silicate and sulfate proportions are similarly varied over the ranges given and when no nonionic is utilized in the crutcher mix and from 1 to 5% thereof is post-sprayed onto the tumbling product. Good results also obtain when in place of 1% of the sodium sulfate in the crutcher mix, there is post-added to the product 1% of enzyme or minor percentage of heat-unstable salts or other materials, e.g., sodium bicarbonate. In all such cases the products made have pH's of 1% solutions in the 8 to 10 range, preferably 8 to 9.5.

EXAMPLE 2

Following the procedure described in Example 1 there is made a product of the following final formulation:

| | Parts |
|---|---|
| Sodium linear tridecyl benzene sulfonate | 18 |
| Sodium silicate ($Na_2O:SiO_2$ = 1:2.4) | 25 |
| Sodium soap (coco:tallow = 15:85) | 6 |
| Nonionic Detergent** | 3.0 |
| Sodium sulfate | 39.8 |
| Sodium carboxymethyl cellulose | 2.0 |
| Perfume | 0.2 |
| Water | 6.0 |

**Neodol 45–11

The product is made by spray drying according to the method previously described, after which the CMC is mixed in with the detergent beads and the Neodol 45-11 is sprayed onto them, also by the techniques previously mentioned.

The product resulting is an excellent built heavy duty laundry detergent which does not flow as well as desired but is almost completely non-tacky, with or without addition of Satintone or Cab-O-Sil (1%) and has a bulk density of about 0.3 g./ml. Addition of Satintone improves the flowability to good. The product is substantially all within the 8 to 100 mesh range and has less than 1% material passing a 200 mesh sieve.

When instead of the anionic detergent described, mixtures of equal parts of the various detergents mentioned in Example 1 are employed as the anionic detergent(s) and when Neodol 25–7 is employed in equal parts with Neodol 45-11 (1% each), good, free-flowing, excellent detergents are also produced, especially with 1% clay present. The addition of up to 5% of various adjuvants such as fluorescent brighteners, dyes, bactericides, anti-foaming agents, antioxidants and preservatives does not adversely affect either the flowability or the detergency of the product.

When variations are made in the experiments of Examples 1 and 2 so as to change the proportions of materials within the ranges given in the specification and to change the processing conditions, as mentioned, good products are also produced by these feasible commercial processes. Such products are not objectionably tacky and are free-flowing so that they can be filled by automatic packaging equipment and will not cake in the box during storage. The processes described do not result in any objectionable pluming from the spray tower and air pollution is minimized by following them.

EXAMPLE 3

| | Parts |
|---|---|
| Sodium linear tridecyl benzene sulfonate | 25 |
| Sodium silicate ($Na_2O:SiO_2$ = 1:2.35) | 25 |
| Nonyl phenol polyoxyethylene ethanol (Igepal CO-880) | 1.0 |
| Sodium carboxymethyl cellulose (or PVA) | 3.0 |
| Sodium sulfate | 38.9 |
| Perfume | 0.1 |
| Water | 7.0 |

The above formula is made by the method described in Example 1 and is repeated, using a pilot plant spray dryer and a laboratory tumbling drum. In one case, pyrogenic silica (Cab-O-Sil) or calcined aluminum silicate (Satintone) flow-inducing agent is added to the extent of 1% of the product and in the other case none of such material is added. Both products flow well although that with the additive is freer flowing and is also non-tacky. In the formulation described, the nonionic detergent is completely post-sprayed onto the detergent particles and none at all of the sodium carboxymethyl cellulose is included in the crutcher mix, with the total being post-added by mixing with the detergent beads before spraying onto them of the perfume and nonionic detergent.

In similar cases when the various components of the product are mixed together as dry powders (little or no spray drying effected) the product made is not as good flowing and requires larger proportions of Satintone or Cab-O-Sil (up to 2%) to promote flow.

The invention has been described with respect to various disclosures and illustrative examples thereof. It is not to be so limited since it should be apparent to one of skill in the art that substitutions may be made and equivalents may be employed without departing from the spirit of the invention.

What is claimed is:

1. A method of preparing a particulate detergent composition which comprises spraying onto a particulate base detergent composition consisting essentially of a water soluble anionic sulf(on)ate synthetic organic detergent having a higher linear alkyl chain therein, 0 to about 36 nonionic detergent, sodium silicate and adjuvant(s), the particles of which are substantially all within the 6 to 140 mesh U.S. Standard Sieve series range and contain less than 5% of particles passing through a 200 mesh sieve, with the ratio of sulf(on)ate detergent to sodium silicate being from 3:1 to 1:3 and with said sodium silicate being of a $Na_2O:SiO_2$ ratio in the range of 1:1.6 to 1:3, while maintaining the particles in motion, from 1 to 6% of a normally solid nonionic detergent in liquid state, at a temperature of 40° to 90° C., with the amount of nonionic detergent in the product being from 1/15 to 1/4 that of the anionic detergent, said nonionic detergent being selected from the group consisting of higher alkoxy poly-lower alkoxy lower alkanols and nonyl or higher alkyl aryloxy poly-lower alkoxy lower alkanols wherein higher designates a carbon atom content of 10 to 16, lower designates a carbon atom content of 2 to 3 and the aryl of the aryloxy radical is selected from the group consisting of phenyl, toluyl and xylyl and the poly-lower alkoxy lower alkanol group in said nonionic detergent compound contains 4 to 100 mols of lower alkylene oxide per mol.

2. A method according to clim 1 wherein the final detergent composition is phosphate- and carbonate-free, the water soluble anionic sulf(on)ate synthetic organic detergent is selected from the group consisting of linear higher alkyl benzene sulfonates, linear higher alkenyl sulfonates, linear hydroxy-higher alkane sulfonates wherein the hydroxyl is not directly joined to a carbon atom alpha to the sulfonate group, linear higher aliphatic ether sulfates and higher alkyl sulfates, the particles onto which nonionic detergent is sprayed are made by spray drying an aqueous crutcher mix of the anionic detergent, sodium silicate and any nonionic detergent, and prior to, during or subsequent to spraying of the nonionic detergent onto the particles there is mixed with the particles a powdered synthetic organic or natural gum anti-redeposition agent.

3. A method according to claim 1 wherein the final detergent composition is phosphate-and carbonate-free, and said spraying step is carried out in the absence of enzymes.

4. A method according to claim 2 wherein the water soluble sulf(on)ate synthetic organic detergent is sodium linear higher alkyl benzene sulfonate in which the higher alkyl is of 10 to 18 carbon atoms, the sodium silicate is of an $Na_2O:SiO_2$ ratio of 1:2 to 1:2.7, the nonionic detergent sprayed onto the surfaces of the spray dried particles is a higher alkoxy polyethoxy ethanol having 12 to 18 carbon atoms in the higher alkoxy group and 7 to 15 ethoxies in the polyethoxy ethanol moiety, sodium sulfate is present in the spray dried particles of the detergent composition and the anti-redeposition agent is sodium carboxymethyl cellulose.

5. A method according to claim 4 wherein the final composition comprises about 15 to 35% of water soluble anionic sulf(on)ate synthetic organic detergent, 15 to 35% of sodium silicate, 1 to 8% of nonionic detergent, 10 to 65% of sodium sulfate, from 0.5 to 5% of anti-redeposition agent and 3 to 15% of moisture, and the nonionic detergent is sprayed onto the spray dried particles as a finely divided spray of droplet diameters in the 5 microns to 2 millimeters range at a spray liquid temperature of 40° to 70° C., while tumbling the spray dried particles in an inclined tumbling drum, partially filled with detergent particles.

6. A method according to claim 4 wherein the final composition comprises about 15 to 35% of sodium linear higher alkyl benzene sulfonate in which the higher alkyl is of 10 to 18 carbon atoms, 15 to 35% of sodium silicate of an $Na_2O:SiO_2$ ratio of 1:2 to 1:2.7, 1 to 8% of nonionic detergent which is a higher alkoxy polyethoxy ethanol having 12 to 18 carbon atoms in the higher alkoxy group and 7 to 15 ethoxies in the polyethoxy ethanol moiety thereof, 10 to 65% of sodium sulfate, 0.5 to 5% of sodium carboxymethyl cellulose and 3 to 15% of moisture, the sodium sulfate, sodium silicate, higher alkyl benzene sulfonate and up to 3% of the nonionic detergent, being crutched and sprayed together to form the spray dried base particles of the detergent composition and the balance of a nonionic detergent being sprayed onto the particles in droplets of diameters in the 5 microns to 2 millimeters range at a spray liquid temperature of 40° to 70° C., while mixing and tumbling the spray dried particles.

7. A method according to claim 6 wherein the nonionic detergent is one having a higher alkoxy group of 12 to 15 carbon atoms, the sodium linear higher alkyl benzene sulfonate is of 12 to 14 carbon atoms in the alkyl group thereof, an inert finely divided flow-inducing powder water insoluble inorganic is added to the tumbling product after additions of other components and spraying onto the surfaces of the particles of the nonionic detergent, and the tumbling and spraying operations are effected continuously in a tumbling drum within an hour after spray drying, while the base particles are still warm, at a temperature of 30° to 45° C.

8. A method according to claim 7 wherein the final composition comprises 20 to 30% of sodium linear tridecyl benzene sulfonate, 20 to 30% of sodium silicate, 2 to 5% of nonionic detergent, 20 to 50% of sodium sulfate, 1 to 3% of anti-redeposition agent and 5 to 12% of moisture.

9. A method according to claim 8 wherein 2 to 6% of sodium higher fatty acid soap, on a final product basis, is admixed with the composition in the crutcher and is spray dried with it.

10. A method according to claim 9 wherein from ½ to 2%, on a final product basis, of calcined aluminum silicate flow promoting agent, in finely divided form, is admixed with the detergent composition near the end of the tumbling operation.

* * * * *